US011737639B2

(12) United States Patent
Büsing et al.

(10) Patent No.: US 11,737,639 B2
(45) Date of Patent: Aug. 29, 2023

(54) DISHWASHER

(71) Applicant: Samsung Electronics Co., Ltd., Suwon-si (KR)

(72) Inventors: Johannes Büsing, Suwon-si (KR); Chang Wook Lee, Suwon-si (KR); Kyu Ha Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 179 days.

(21) Appl. No.: 16/728,638

(22) Filed: Dec. 27, 2019

(65) Prior Publication Data

US 2020/0205639 A1 Jul. 2, 2020

(30) Foreign Application Priority Data

Dec. 28, 2018 (KR) ..... 10-2018-0171960
Mar. 22, 2019 (KR) ..... 10-2019-0032999

(51) Int. Cl.
*A47L 15/42* (2006.01)
*A47L 15/14* (2006.01)

(52) U.S. Cl.
CPC ..... *A47L 15/4221* (2013.01); *A47L 15/14* (2013.01); *A47L 15/4217* (2013.01); *A47L 15/4225* (2013.01)

(58) Field of Classification Search
CPC .. A47L 15/4221; A47L 15/14; A47L 15/4217; A47L 15/4225; A47L 15/4246; A47L 15/4219
See application file for complete search history.

(56) References Cited

U.S. PATENT DOCUMENTS 3,963,046 A 6/1976 Bergeson
5,131,420 A * 7/1992 Favret ..... A47L 15/4225 415/58.4
6,189,550 B1 2/2001 Stickel et al.
(Continued)

FOREIGN PATENT DOCUMENTS

DE 3428439 2/1986
DE 102006048377 5/2007
(Continued)

OTHER PUBLICATIONS

Alnor NPL https://www.ventilation-alnor.co.uk/index/products-en/ducts-and-round-fittings/bends/ (Year: 2017).*
(Continued)

*Primary Examiner* — Michael E Barr
*Assistant Examiner* — Pallavi Chitta
(74) *Attorney, Agent, or Firm* — Staas & Halsey LLP

(57) ABSTRACT

A dishwasher includes a main body, a tub provided in the inside of the main body, a basket provided in the inside of the tub to store dishes, an injection unit configured to spray wash water to wash dishes in the basket, and a circulation pump configured to circulate wash water, a sump arranged on a lower surface of the tub, and a connector provided to connect the circulation pump to the injection unit and having a tubular shape. The sump includes a coupling portion extending upward from the lower surface of the tub, and the connector and the injection unit are connected to each other in the inside of the tub by being coupled to the coupling portion.

14 Claims, 14 Drawing Sheets

(56) References Cited

U.S. PATENT DOCUMENTS

| | | | | |
|---|---|---|---|---|
| 2010/0236588 | A1 | 9/2010 | Büsing et al. | |
| 2012/0018996 | A1 | 1/2012 | Stempfle | |
| 2014/0076369 | A1* | 3/2014 | Park | A47L 15/428 134/174 |
| 2015/0150430 | A1 | 6/2015 | Wee et al. | |
| 2016/0316992 | A1* | 11/2016 | Lee | A47L 15/18 |

FOREIGN PATENT DOCUMENTS

| | | |
|---|---|---|
| EP | 0524101 | 1/1993 |
| FR | 2236468 | 2/1975 |
| FR | 2412295 | 7/1979 |
| GB | 1514652 | 6/1978 |
| KR | 10-2000-0019779 | 11/2000 |
| KR | 10-2001-0077128 | 8/2001 |
| KR | 10-2004-0046943 | 6/2004 |
| KR | 10-2005-0122360 | 12/2005 |
| KR | 10-2009-0108298 | 10/2009 |

OTHER PUBLICATIONS

International Search Report dated Apr. 29, 2020 in International Patent Application No. PCT/KR2019/018569.
Extended European Search Report dated Jun. 23, 2020 in European Patent Application No. 19219671.5.
Office Action dated Feb. 6, 2023 in European Patent application No. 19 219 671.5 (53 pages).

* cited by examiner

DISHWASHER

CROSS-REFERENCE TO RELATED APPLICATION(S)

This application is based on and claims priority under 35 U.S.C. § 119 to Korean Patent Application No. 10-2018-0171960, filed on Dec. 28, 2018, and to Korean Patent Application No. 10-2019-0032999, filed on Mar. 22, 2019 in the Korean Intellectual Property Office, the disclosures of which are incorporated by reference herein in their entirety.

BACKGROUND

1. Field

The disclosure relates to a dishwasher, more particularly, to a dishwasher including a connector, which is arranged between an injection unit and a circulation pump, having an improved structure.

2. Description of Related Art

A dishwasher is a device that automatically cleans food residues on dishes using detergent and wash water.

The dishwasher includes a main body, a tub arranged in the inside of the main body, a storage container arranged in the inside of the tub to accommodate dishes, and an injection unit configured to spray wash water into the storage container.

The storage container may be usually provided as two storage containers or three storage containers. A plurality of injection units may be configured to spray the wash water to a place where each storage container is positioned and thus the plurality of injection units may be arranged in accordance with the position of the storage containers.

The dishwasher includes a connector connected to an alternating device for distributing wash water or a circulation pump arranged below a washing chamber for providing wash water to a lower injection unit that is among the plurality of injection units and arranged on a lower portion of the tub.

The connector may directly connect the lower injection unit to the pump or the alternating device, which may cause a difficulty in that the arrangement of the connector is not easy due to the narrow space below the washing chamber.

SUMMARY

Therefore, it is an aspect of the disclosure to provide a dishwasher including an improved coupling structure between a connector and a lower injection unit.

It is an aspect of the disclosure to provide a dishwasher including an improved sealing structure between a connector and a lower injection unit.

It is an aspect of the disclosure to provide a dishwasher including a connector capable of improving a flow of wash water in the connector.

Additional aspects will be set forth in part in the description which follows and, in part, will be apparent from the description, or may be learned by practice of the presented embodiments.

In accordance with an aspect of the disclosure, a dishwasher includes a main body, a tub provided in the inside of the main body, a basket provided in the inside of the tub to store dishes, an injection unit configured to spray wash water to wash dishes in the basket, and a circulation pump configured to circulate wash water, a sump arranged on a lower surface of the tub, and a connector provided to connect the circulation pump to the injection unit and having a tubular shape. The sump includes a coupling portion extending upward from the lower surface of the tub, and the connector and the injection unit are connected to each other in the inside of the tub by being coupled to the coupling portion.

The sump may include a reservoir provided to store wash water and a sump housing provided to form the reservoir, and the sump housing may include a sump extension provided to extend outward from an upper portion of the reservoir, and the coupling portion may be provided to extend upward from the sump extension.

The connector may include a first region coupled to the coupling portion at an upper side of the lower surface of the tub, a second region into which wash water provided from the circulation pump flows, a third region arranged between the first region and the second region, a first body portion arranged in the first region and provided to extend in a first direction, a second body portion arranged in the second region and provided to extend in a second direction perpendicular to the first direction, and a third body portion arranged in the third region and provided to be bent from the second direction to the first direction, and the connector may include an inner curved surface formed in the inside of the first body portion and the third body portion and provided to be bent from the second direction to the first direction.

The coupling portion may include a coupling tube including a hollow formed in the sump extension, the coupling tube provided to extend upward from the sump extension, and the first region may be fitted into the coupling tube through the hollow of the coupling tube.

The connector may include a first sealing portion in contact with an inner circumferential surface of the coupling tube to seal the connector and the coupling portion, and the first sealing portion may be provided to extend radially outward from the first body portion.

The coupling tube may include an annular flange extending from an inner circumferential surface of the coupling tube to the center of the coupling tube and including an annular insertion groove provided to be concave downward, and the first region further may include an insertion portion inserted into the insertion groove in a vertical direction.

The flange may extend from a lower end of the inner circumferential surface of the coupling tube toward the center of the coupling tube, and a diameter of the inner circumferential surface of the coupling tube may be greater than a diameter of an inner circumferential end of the flange.

The dishwasher may further include an intermediate member arranged between the injection unit and the coupling tube to guide coupling between the injection unit and the coupling portion, and the injection unit may include an inlet provided to be inserted into the inside of the connector and configured to flow wash water to the inside of the injection unit, and the intermediate member may be arranged between the first region and the inlet in a radial direction of the coupling tube.

The connector may further include a first sealing portion in contact with the inner circumferential surface of the coupling tube and a second sealing portion arranged opposite to the first sealing portion and sealed with the intermediate member, and the intermediate member may include a third sealing portion in contact with the second sealing portion.

The intermediate member may further include a guide including one end communicating with an upper end of the inner curved surface and the other end communicating with a lower end of the inlet to guide wash water to the inlet, and an opening at an upper end of the guide may correspond to an opening at a lower end of the inlet, and an opening at a lower end of the guide may correspond to an opening at an upper end of the inner curved surface.

A diameter of the opening at the upper end of the guide may be less than a diameter of the opening at the lower end of the guide.

The inner circumferential surface of the guide may include a curved surface of the guide connected to the inner curved surface.

The sump may further include a filter arranged above the sump housing and configured to prevent foreign substances from entering the sump housing, and the coupling portion may be arranged between the filter and the lower surface of the tub.

The intermediate member may include a filter support provided to extend radially outward of the intermediate member and configured to support the filter.

The dishwasher may further include an alternating device configured to distribute wash water pumped by the circulation pump, and the second region may be directly coupled to the alternating device.

In accordance with an aspect of the disclosure, a dishwasher includes a main body, a tub provided in the inside of the main body, a basket provided in the inside of the tub to store dishes, an injection unit configured to spray wash water to wash dishes in the basket, a circulation pump configured to circulate wash water, and a connector provided to connect the circulation pump to the injection unit and having a tubular shape, and one end of the connector is arranged in the inside of the tub and the other end of the connector is bent at one end of the connector and arranged on the outside of the tub.

The dishwasher may further include a sump arranged on a lower surface of the tub, and the sump may include a reservoir provided to store wash water and a sump housing provided to form the reservoir, and the sump housing may include a coupling tube provided to extend upward from the sump housing so as to be arranged on an upper side than the lower surface of the tub, and one end of the connector may be inserted into the inside of the coupling tube.

The connector may include a first region including one end of the connector and coupled to the coupling tube, a second region including the other end of the connector and extending perpendicular to an extending direction of the first region, and a third region provided to connect the first region to the second region, and an inner surface of the first region and the third region may include an inner curved surface provided to extend to the first region along the third region.

The injection unit may be inserted into the first region, and a cross section of the inside of the first region in a vertical direction may gradually increase downward from a portion adjacent to a lower end of the injection unit.

In accordance with an aspect of the disclosure, a dishwasher includes a main body, a tub provided in the inside of the main body, a sump arranged on a lower surface of the tub, a basket provided in the inside of a washing chamber to store dishes, an injection unit configured to spray wash water to wash dishes in the basket, a circulation pump configured to circulate wash water, a connector provided to connect the circulation pump to the injection unit and having a tubular shape, and a filter arranged above the sump to prevent foreign substances from entering the inside of the sump. The sump includes a reservoir provided to store wash water, a sump housing provided to form the reservoir, and a coupling portion provided to extend upward from the sump housing in a tubular shape, the coupling portion in which the injection unit and the connector are coupled to each other in the vertical direction. The coupling portion is arranged to be coupled between the filter and the lower surface of the tub, and an outer circumferential surface of the connector is sealed with an inner circumferential surface of the coupling portion.

BRIEF DESCRIPTION OF THE DRAWINGS

The above and other aspects, features, and advantages of particular embodiments of the present disclosure will be more apparent from the following description taken in conjunction with the accompanying drawings, in which.

DETAILED DESCRIPTION

Figure 1:
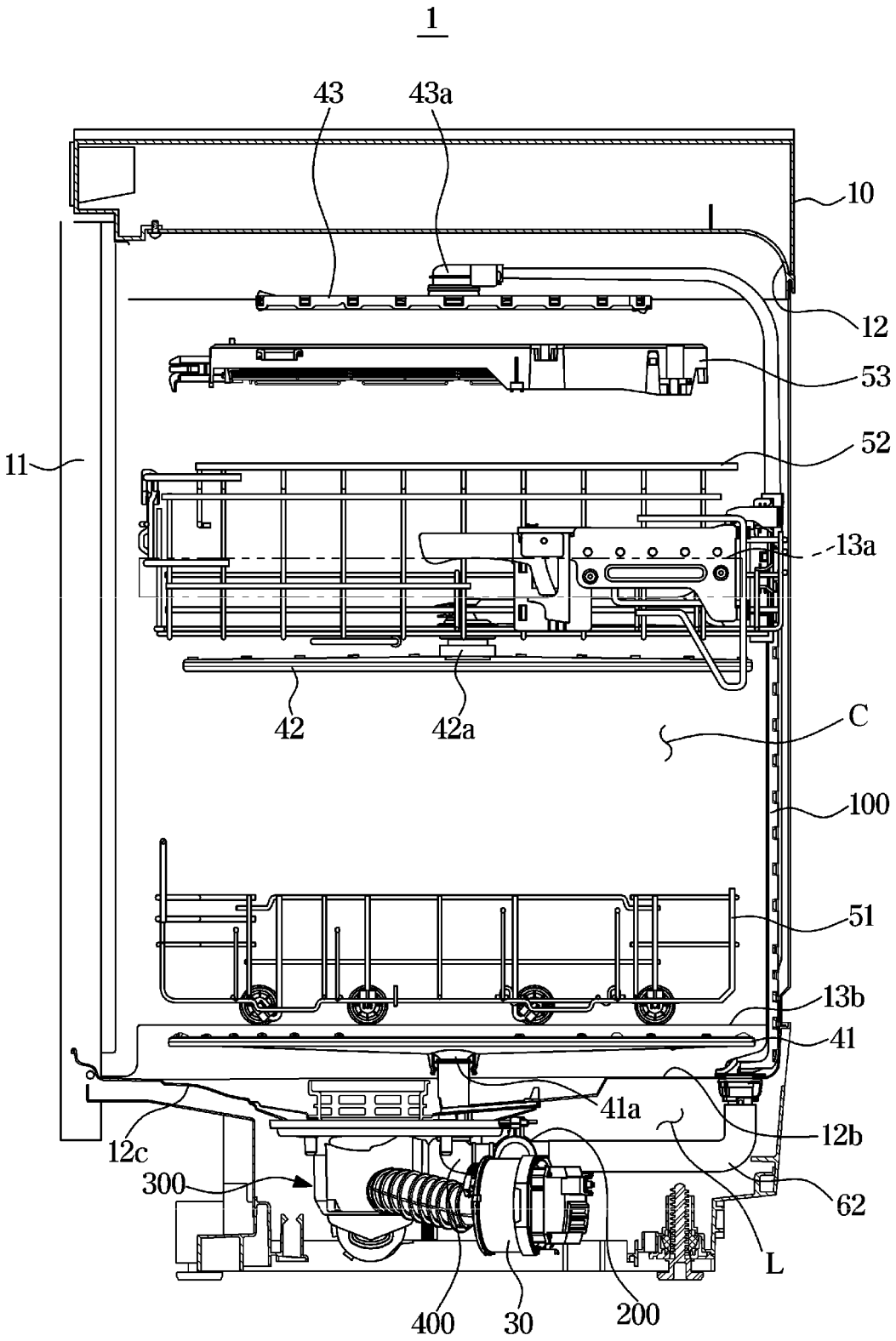
FIG. 1 is a schematic cross-sectional view of a dishwasher according to an embodiment of the disclosure.

Hereinafter embodiments of the disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

Hereinafter dishes may be used as a concept including a bowl, a cup, a cutlery, and various cooking utensils.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Figure 2:
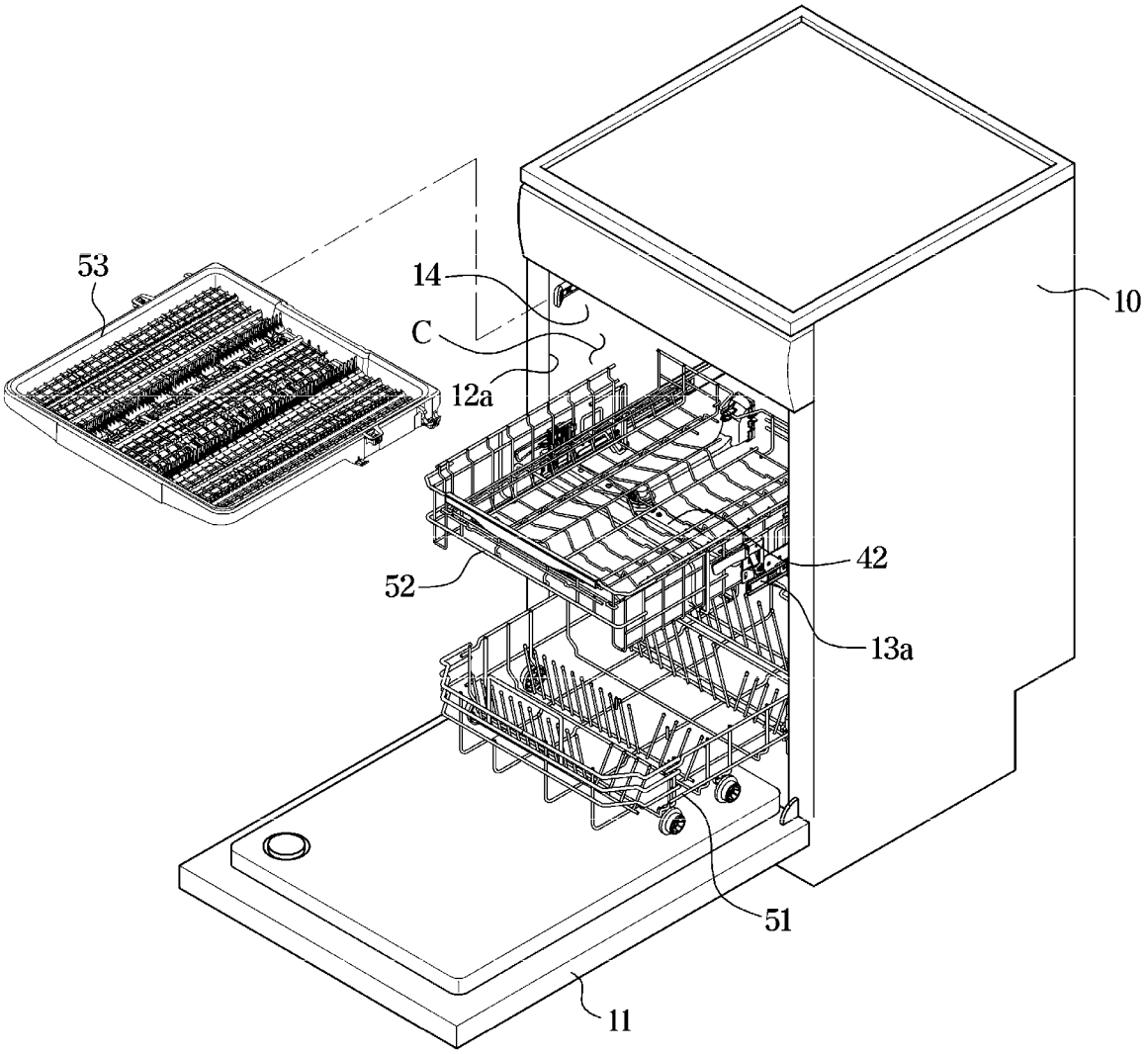
FIG. 2 is a perspective view of the dishwasher according to an embodiment of the disclosure.
Figure 3:
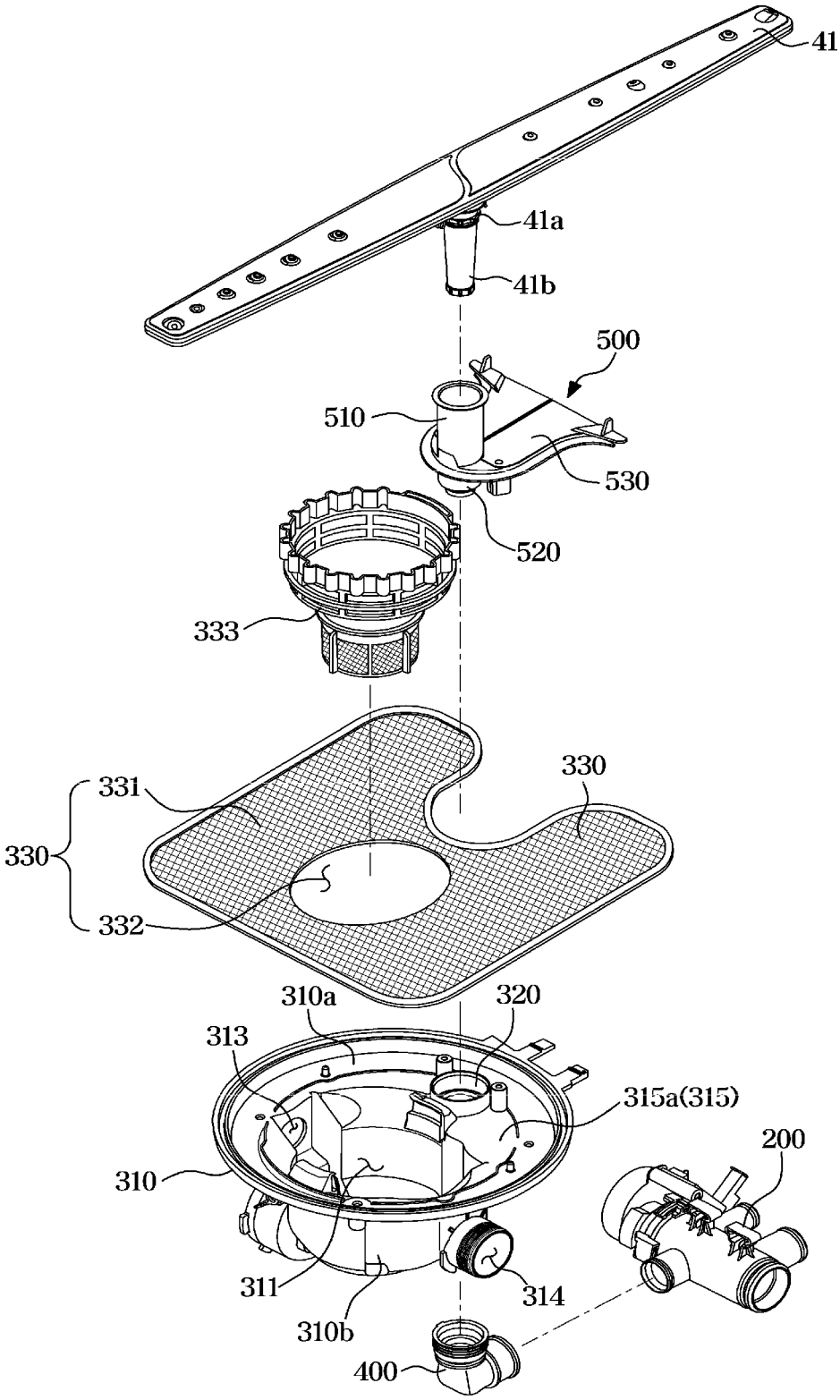
FIG. 3 is an exploded perspective view of some components of the dishwasher according to an embodiment of the disclosure.

FIG. 1 is a cross-sectional view of a dishwasher according to an embodiment of the disclosure, FIG. 2 is a perspective view of the dishwasher according to an embodiment of the disclosure, and FIG. 3 is an exploded perspective view of some components of the dishwasher according to an embodiment of the disclosure.

As illustrated in FIGS. 1 and 2, the dishwasher 1 may include a main body 10 forming an external appearance of the dishwasher.

The dishwasher 1 may further include a tub 12 provided in the inside of the main body 10. The tub 12 may be provided in a substantially box shape. One side of the tub 12 may be open. That is, the tub 12 may have an opening 12*a*. As an example, a front surface of the tub 12 may be open.

The dishwasher 1 may further include a door 11 configured to open and close the opening 12*a* of the tub 12. The door 11 may be installed in the main body 10 to open and close the opening 12*a* of the tub 12. The door 11 may be installed in the main body 10 to be rotatable.

The dishwasher 1 may further include a storage container provided in the tub 12 to store dishes.

The storage container may include a plurality of baskets 51, 52, and 53. Relatively large dishes may be stored in the plurality of baskets 51 and 52. However, the kind of dishes stored in the plurality of baskets 51, 52, and 53 is not limited to relatively large dishes. That is, the plurality of baskets 51, 52, and 53 may store not only relatively large dishes but also relatively small dishes.

The plurality of baskets 51, 52, and 53 may include an intermediate basket 52 positioned in the middle of the height of the dishwasher 1, and a lower basket 51 positioned in a lower portion in the height direction of the dishwasher 1. The intermediate basket 52 may be provided to be supported by an intermediate guide rack 13*a*, and the lower basket 51 may be provided to be supported by a lower guide rack 13*b*. The intermediate guide rack 13*a* and the lower guide rack 13*b* may be installed on a side surface 14 of the tub 12 so as to be slidable toward the opening 12*a* of the tub 12. The side surface 14 of the tub 12 may be a surface including an inner surface of a right wall and an inner surface of a left wall of the tub 12.

The storage container may include an upper basket 53 positioned in an upper portion of the height of the dishwasher 1. The upper basket 53 may be formed in a rack assembly to store relatively small dishes. The upper basket 53 may store a cooking utensil such as a ladle, a knife, or a turner, or cutlery. In addition, the rack assembly may accommodate a small cup such as an espresso cup. However, the kind of dishes accommodated in the upper basket 53 is not limited to the above example.

In addition, the configuration of the baskets is not limited thereto, and thus according to the size of the tub 12, the upper basket 53 may not be included. Therefore, the storage container may be implemented only with the intermediate basket 52 and the lower basket 51.

The dishwasher 1 may further include a sump 300 configured to store the wash water. The dishwasher 1 may include a washing chamber C corresponding to a space formed by the inside of the tub 12.

The washing chamber C is a space in which the dishes placed in the baskets 51, 52, and 53 are washed by the wash water and then dried.

The washing chamber C may be defined as an inner space of the tub 12 formed by the side surface 14, the front and rear surface, a lower surface 12*b*, and the sump 300 communicating with the lower surface 12*b*. The side surface 14, the front and rear surface, and the lower surface of the tub 12 forming the washing chamber C may represent surfaces directed to the center of the inside of the tub 12. The wash water circulated in the washing chamber C may be sealed to prevent the wash water being leaked to the outside of the washing chamber C through a component except for the sump 300.

The dishwasher 1 may further include injection units 41, 42, and 43 configured to spray wash water. The injection units 41, 42, and 43 may include a first injection unit 41 arranged below the lower basket 51 in the height direction of the dishwasher 1, a second injection unit 42 arranged below the intermediate basket 52 in the height direction of the dishwasher 1, and a third injection unit 43 arranged above the upper basket 53 in the height direction of the dishwasher 1.

The first injection unit 41 may be rotatable about a rotating shaft 41*a*, the second injection unit 42 may be rotatable about a rotating shaft 42*a*, and the third injection unit 43 may be rotatable about a rotating shaft 43*a*.

However, the position of the injection unit is not limited thereto, and thus the first injection unit 41 may be fixed to one side of the lower portion of the washing chamber C unlike the second injection unit 42 and the third injection unit 43. In this case, the first injection unit 41 may be configured to spray water in a substantially horizontal direction by a fixed nozzle, and the wash water sprayed in the horizontal direction from the nozzle of the first injection unit 41 may be directed to the upper side because a direction of the sprayed water is changed by a switching assembly. The switching assembly may be installed on a rail by a holder and translated along the rail.

The third injection unit 43 may spray the wash water toward the dishes stored in the upper basket 53 and the intermediate and lower baskets 52 and 51, and the second injection unit 42 may spray the wash water toward the dishes stored in the intermediate basket 52 and the upper basket 53.

Unlike the second injection unit 42 and the third injection unit 43, the first injection unit 41 may be fixed to the lower surface 12*b* of the tub 12, particularly to the inside of the sump 300.

The dishwasher 1 may include a circulation pump 30 configured to pump water stored in the sump 300 toward the injection units 41, 42, and 43. The wash water pumped by the circulation pump 30 may be supplied to the first injection unit 41 through an alternating device 200 connected to the circulation pump 30. Alternatively, the wash water pumped by the circulation pump 30 may be moved upward by a duct 100 to be described later and then supplied to the second injection unit 42 or the third injection unit 43.

As described above, the wash water stored in the sump 300 or wash water introduced into the dishwasher 1 from the outside may flow to the alternating device 200 by the circulation pump 30.

The alternating device 200 may provide the wash water to the first injection unit 41 through a connector 400 connected to the first injection unit 41, and may provide the wash water to the duct 100 through a flow path 62 connected to the duct 100.

The alternating device 200 may selectively provide the wash water to at least one of the connector 400 and the duct 100.

At least a part of the connector 400 and the flow path 62 may be arranged in a machine room L below the washing chamber C. That is, at least a part of the connector 400 and the flow path 62 may be arranged in a lower position than the lower surface 12*b* of the tub 12 with respect to the height direction of the dishwasher 1. The wash water may flow into the first injection unit 41 and the duct 100 arranged in the washing chamber C through the connector 400 and the flow path 62.

The wash water may flow into the second injection unit 42 and the third injection unit 43 through the duct 100. (The first injection unit, the second injection unit, and the third injection unit of the injection unit may be referred to as a first rotor, a second rotor, and a third rotor of the injection unit, respectively. However, hereafter the injection unit will be referred to as the first injection unit, the second injection unit, and the third injection unit. In addition, the names of the injection unit are not limited thereto, and conversely, the injection units may be referred to as the first injection unit, the second injection unit, and the first injection unit in order from the upper side).

As illustrated in FIG. 3, the sump 300 may include a sump housing 310 forming a reservoir 311 configured to store the wash water sprayed in the inside of the tub 12.

The sump housing 310 may form the reservoir 311, and the sump housing 310 may be formed by an inner portion 310*a* forming a sump first surface 315*a* of a sump extension 315 described later, and by an outer portion 310*b* formed on the opposite side of the inner portion 310*a*.

The inner portion 310*a* may be connected to the tub 12 to form at least a part of the washing chamber C. The outer portion 310*b* may not be in direct contact with the wash water and arranged to face the machine room L.

In addition, the dishwasher 1 may include a filter unit 330 arranged above the sump housing 310 and configured to prevent foreign substances from entering the sump 300.

The filter unit 330 may include a filter body 331, a filter opening 332 arranged in the inside of the filter body 331, and a cylindrical coarse filter 333 inserted into the filter opening 332.

The sump 300 may further include an additional filter (not shown) arranged in the inside of the reservoir 311. Accordingly, foreign substances in the circulating wash water may be filtered out by two or three times.

The sump housing 310 may include an outlet 313 communicating with the reservoir 311 and discharging at least a portion of the stored wash water.

The sump housing 310 may include a circulation port 314 communicating with the reservoir 311 and connected to the circulation pump 30 to circulate at least a portion of the stored wash water.

The wash water discharged from the reservoir 311 through the circulation port 314 may be moved to the circulation pump 30 and pumped from the circulation pump 30 and then moved to the injection units 41, 42, and 43.

As described above, the wash water pumped through the circulation pump 30 may flow into the alternating device 200, and may be moved to the connector 400 or the flow path 62 by the alternating device 200.

However, it is not limited thereto, and thus the circulation pump 30 may be directly connected to the connector 400, and the wash water pumped from the circulation pump 30 may be directly introduced without passing through the alternating device 200. In this case, the dishwasher 1 may not include the alternating device 200.

As mentioned above, the washing chamber C is formed with the inner space of the tub 12. The washing chamber C may be formed with the side surface 14, the rear surface, the upper surface and the lower surface 12*b*, which are arranged in the inside of the tub 12, and the inner portion 310*a* of the sump housing 310 of the sump 300 connected to the lower surface 12*b*. The sump 300 may form at least a part of the washing chamber C.

The sump housing 310 may include the sump extension 315 arranged in the upper side of the reservoir 311 and provided to extend outward from an upper end of the reservoir 311. The sump extension 315 may be provided in a flange shape at an upper end of the reservoir 311.

The sump extension 315 may include the sump first surface 315*a* forming an upper surface of the sump extension 315.

The sump first surface 315*a* may be arranged below the lower surface 12*b* of the tub 12 and may face a bottom surface 12*c* formed on an opposite surface of the lower surface 12*b* of the tub 12.

The lower surface 12*b* of the tub 12 and the sump first surface 315*a* may be arranged to overlap each other in the vertical direction. Particularly, the lower surface 12*b* of the tub 12 and at least a portion of the sump first surface 315*a* may be arranged to be superposed in the vertical direction. Therefore, at least a part of the sump first surface 315*a* may be arranged at a height that approximately corresponds to the lower surface 12*b* of the tub 12 with respect to the vertical direction.

The sump first surface 315*a* described below refers to at least a portion of the sump first surface 315*a* arranged at a height approximately corresponding to the lower surface 12*b* of the tub 12 with respect to the vertical direction.

The sump extension 315 and the lower surface 12*b* of the tub 12 and the reservoir 311 may be provided to prevent the wash water from leaking to the outside of the washing chamber C except through the circulation port 314 or the outlet 313 of the reservoir 311. That is, the wash water is discharged only through the circulation port 314 or the outlet 313 of the reservoir 311.

The first injection unit 41 may be fixed to the sump 300. Particularly, the first injection unit 41 may be coupled to a coupling portion 320 formed on the sump 300.

Typically, the sump may be arranged at the center of the lower surface of the tub to collect the wash water, and a lower injection unit formed in the rotor type may also be arranged at the center of the tub for efficient injection.

That is, in order to increase the efficiency, the sump may be arranged at a position similar with a position of the lower injection unit. Therefore, according to an embodiment of the disclosure, in order to increase the efficiency, the first injection unit 41 may be fixed on the sump 300.

However, when the first injection unit 41 is not a rotor type but a type in which a fixed nozzle injects wash water and the injected wash water is sprayed to the inside of the washing chamber C through a switching assembly, the first injection unit 41 may be arranged on not the center, but on one side of the lower surface of the washing chamber C.

The sump 300 may include the coupling portion 320 to which the first injection unit 41 is coupled.

The coupling portion 320 may be arranged on the sump extension 315. Particularly, the coupling portion 320 may be provided to extend upward from the sump first surface 315*a*. Therefore, the coupling portion 320 may be arranged in the upper side of the sump first surface 315*a*, while being arranged in the upper side of the lower surface 12*b* of the tub 12.

In addition, the coupling portion 320 according to an embodiment of the disclosure protrudes upward from the sump extension 315 and functions as a component of the sump 300, but is not limited thereto. Therefore, the coupling portion 320 may be integrally formed with the lower surface 12*b* of the tub 12 and may correspond to a component separated from the sump 300.

That is, the coupling portion 320 may be integrally formed with the lower surface 12*b* of the tub 12 in the shape of a tube extending upward from the lower surface 12*b* of the tub 12. At this time, the first injection unit 41 is not limited to an embodiment of the disclosure, and thus the first injection unit 41 may be coupled to the coupling portion 320 arranged on any one side of the lower surface 12*b* of the tub 12.

The coupling portion 320 is provided to allow the connector 400 to be coupled thereto. The first injection unit 41 may be coupled to the coupling portion 320 from the upper side to the lower side, and the connector 400 may be coupled to the coupling portion 320 from the lower side to the upper side. Accordingly, the connector 400 and the first injection unit 41 may be coupled to the sump 300 through the coupling portion 320. Particularly, the connector 400 and the first injection unit 41 may be coupled to the coupling portion 320 provided in the upper side of the sump first surface 315*a*.

The first injection unit 41 may include an inlet 41*b* provided to allow the wash water to flow through the connector 400. The inlet 41*b* may be inserted into the coupling portion 320 and then coupled to the coupling portion 320. This will be described later in detail.

The dishwasher 1 may include an intermediate member 500 provided to guide coupling of the first injection unit 41 and the coupling portion 320, and arranged between the first injection unit 41 and the coupling portion 320 in a radial direction of the coupling portion 320 with respect to the coupling portion 320.

The intermediate member 500 may be fitted between the coupling portion 320 and the first injection unit 41 so as to allow the coupling portion 320 and the first injection unit 41 to be strongly coupled to each other.

Together with the first injection unit 41, the intermediate member 500 may be coupled to the coupling portion 320 from the upper side to the lower side.

The intermediate member 500 may include a filter support 530 configured to support the filter body 331. The filter supporter 530 may support the center of the filter body 331.

An edge portion of the filter body 331 may be supported by the lower surface 12*b* of the tub 12, and the center of the filter body 331 may be supported by the filter support 530 as mentioned above. Accordingly, the filter body 331 may ensure more rigidity than when the filter body 331 is only supported by the lower surface 12*b* of the tub 12.

Hereinafter the coupling portion 320 and the connector 400 connected to the coupling portion will be described in detail.

Figure 4:
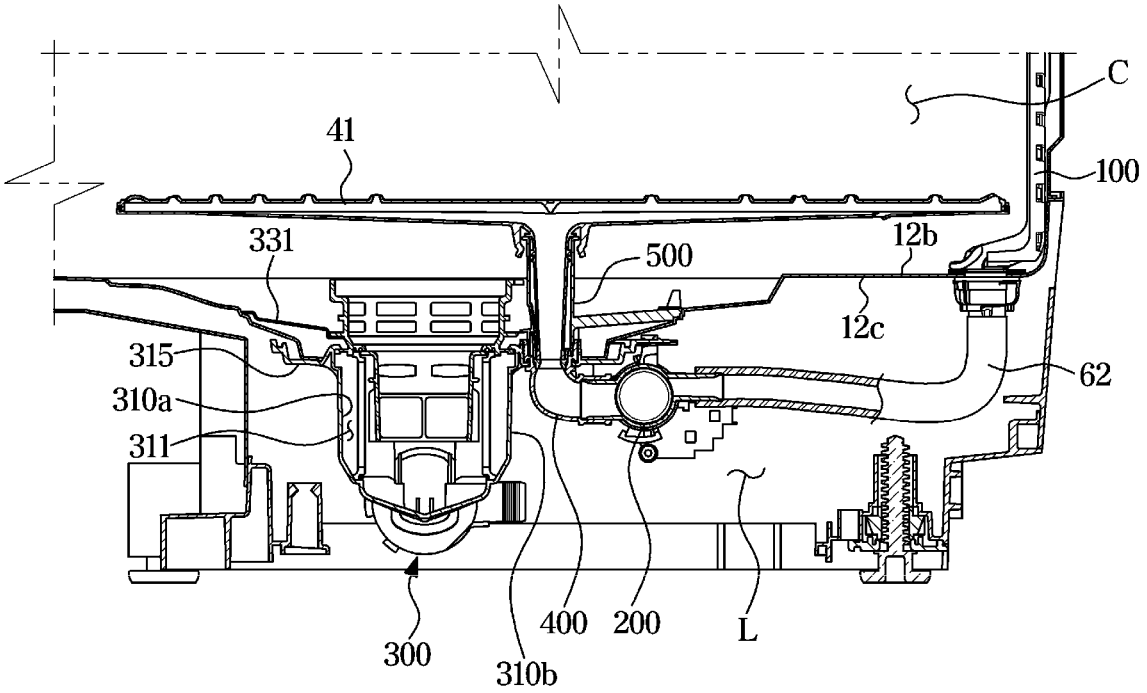
FIG. 4 is a cross-sectional view of a lower portion of the dishwasher according to an embodiment of the disclosure.
Figure 5:
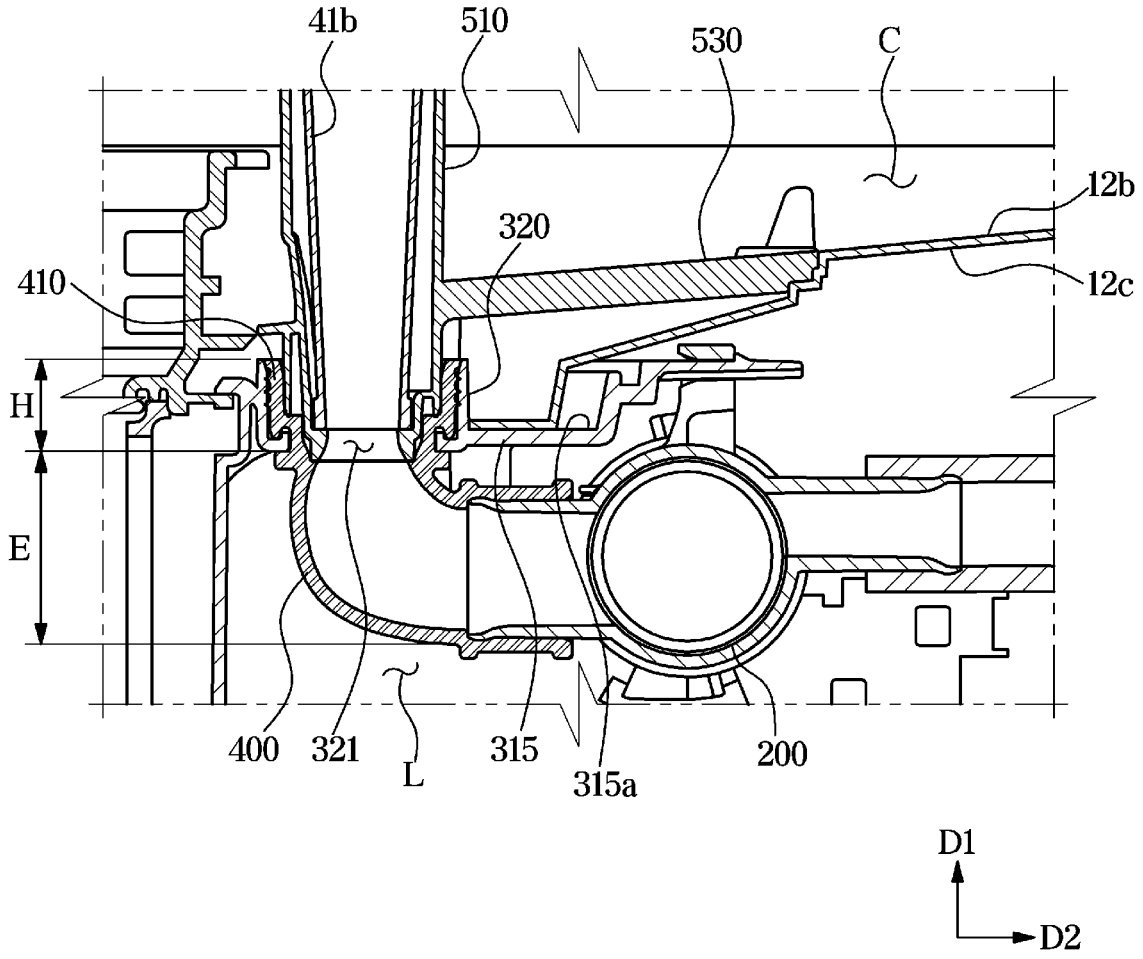
FIG. 5 is cross-sectional view of some components of the dishwasher according to an embodiment of the disclosure.
Figure 6:
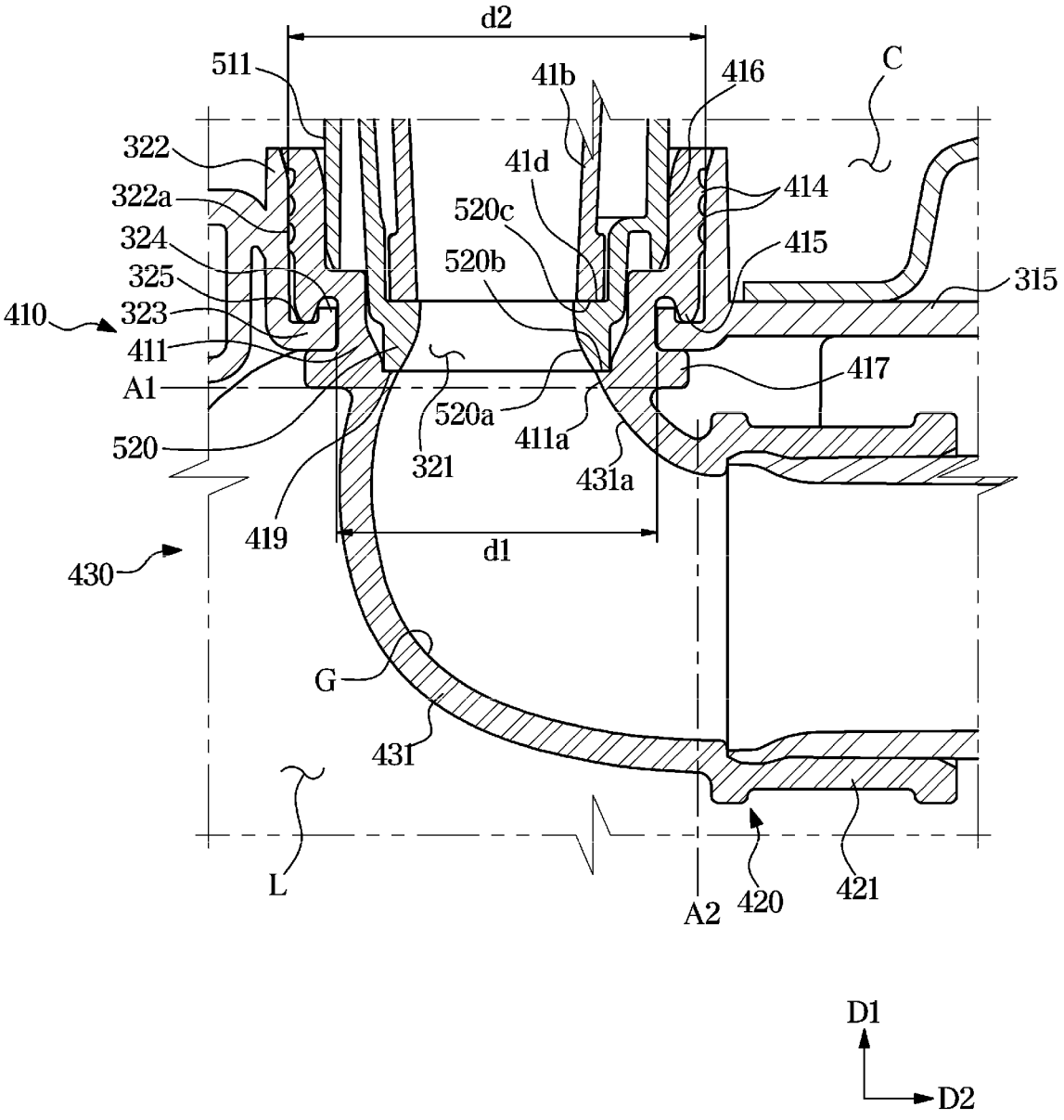
FIG. 6 is an enlarged cross-sectional view of a portion of FIG. 5.
Figure 7:
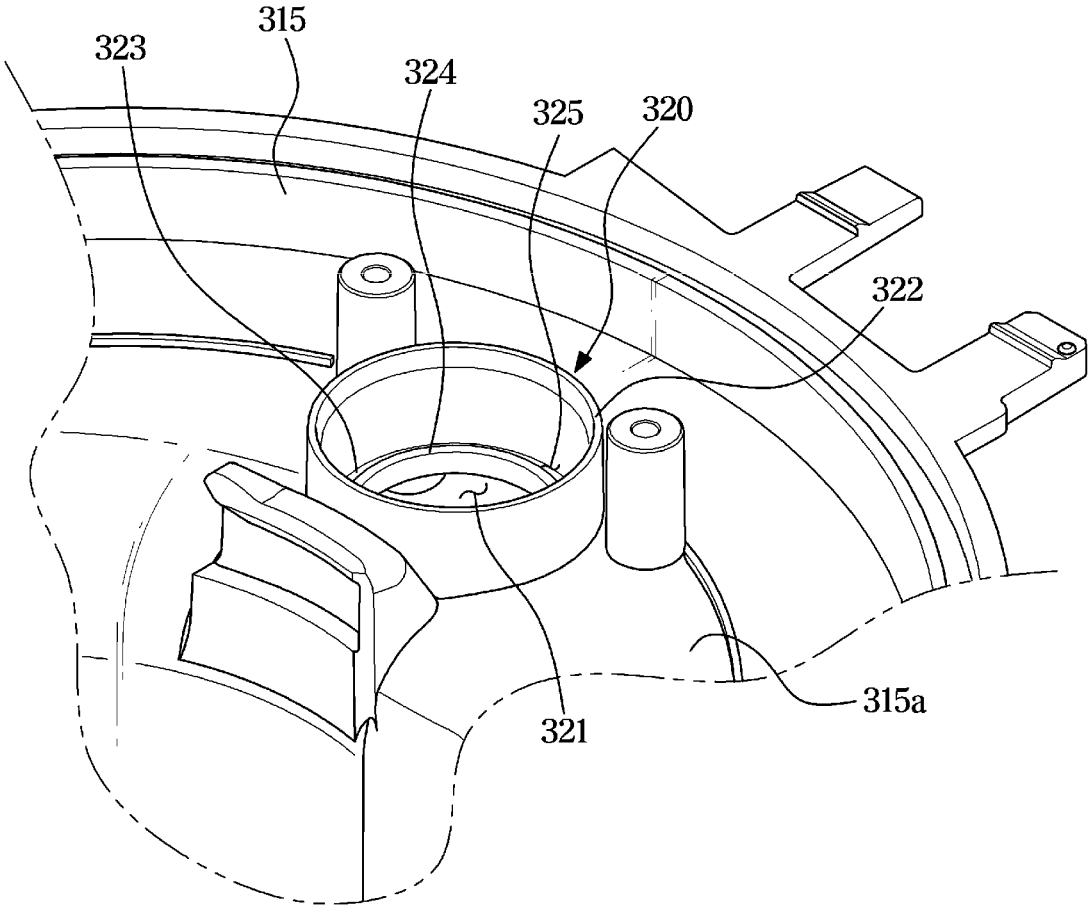
FIG. 7 is an enlarged view of a portion of a sump of the dishwasher according to an embodiment of the disclosure.
Figure 8:
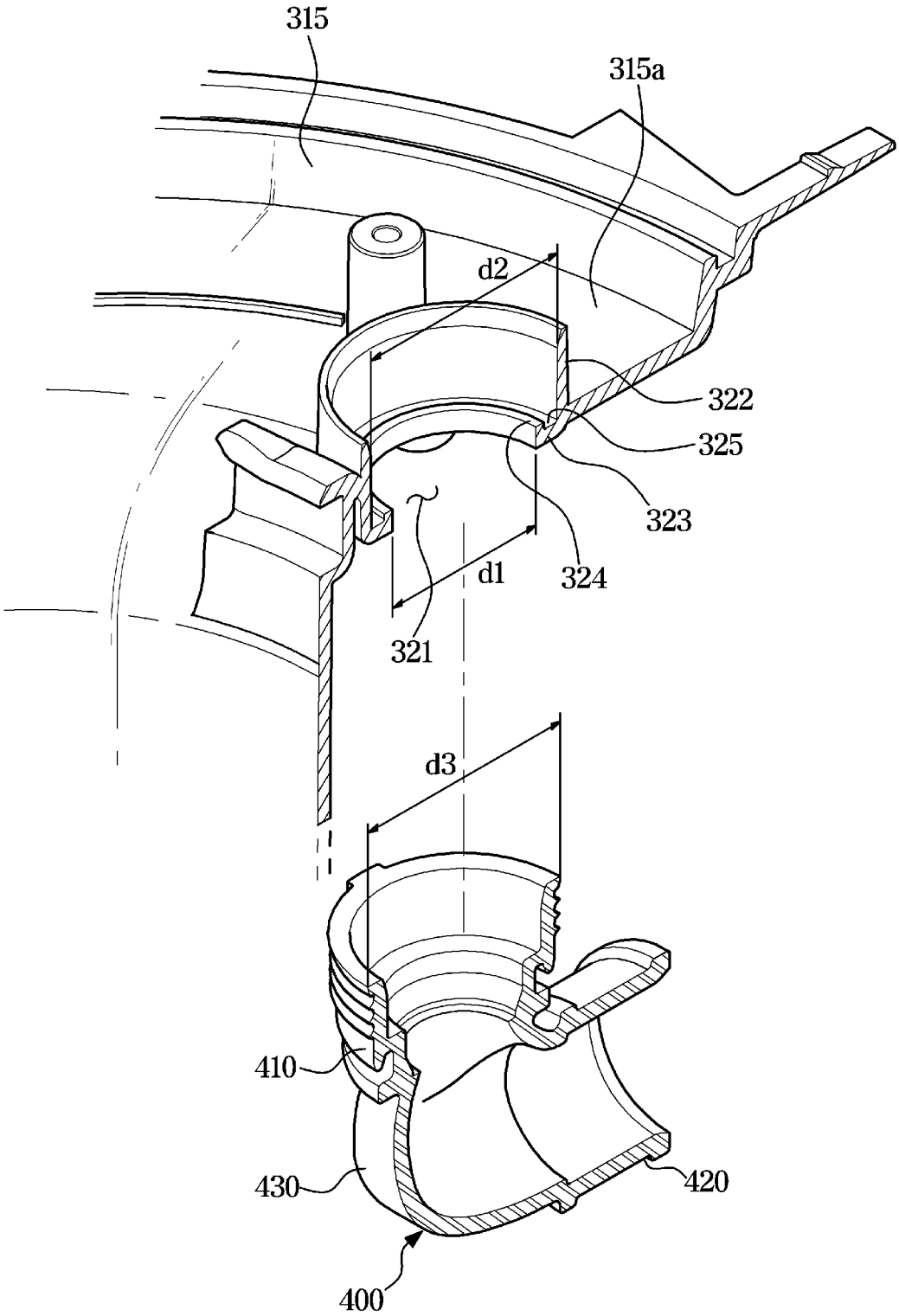
FIG. 8 is a cross-sectional perspective view of the sump of the dishwasher according to an embodiment of the disclosure.
Figure 9:
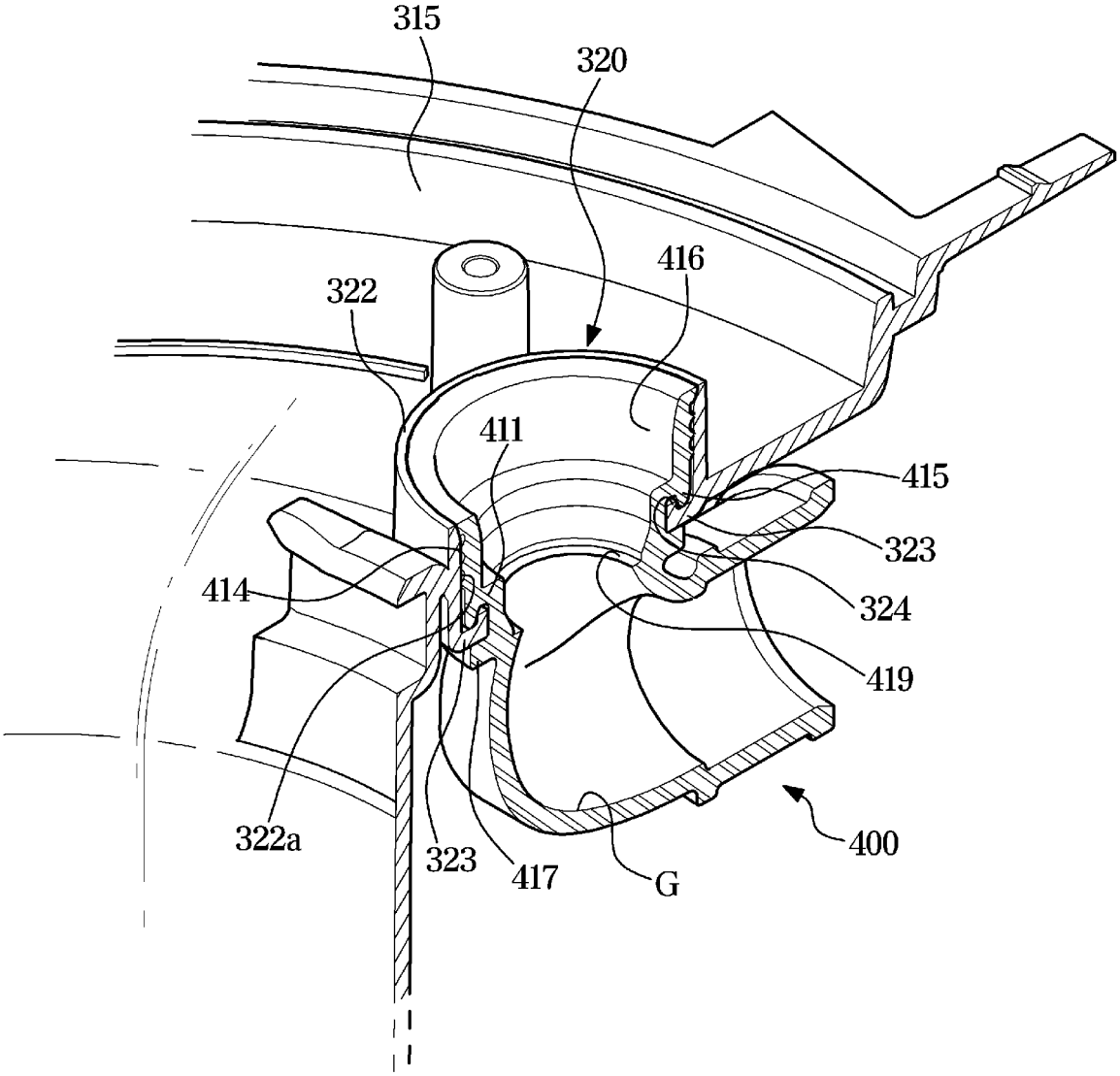
FIG. 9 is a cross-sectional perspective view of a connector and the sump of the dishwasher according to an embodiment of the disclosure.
Figure 10:
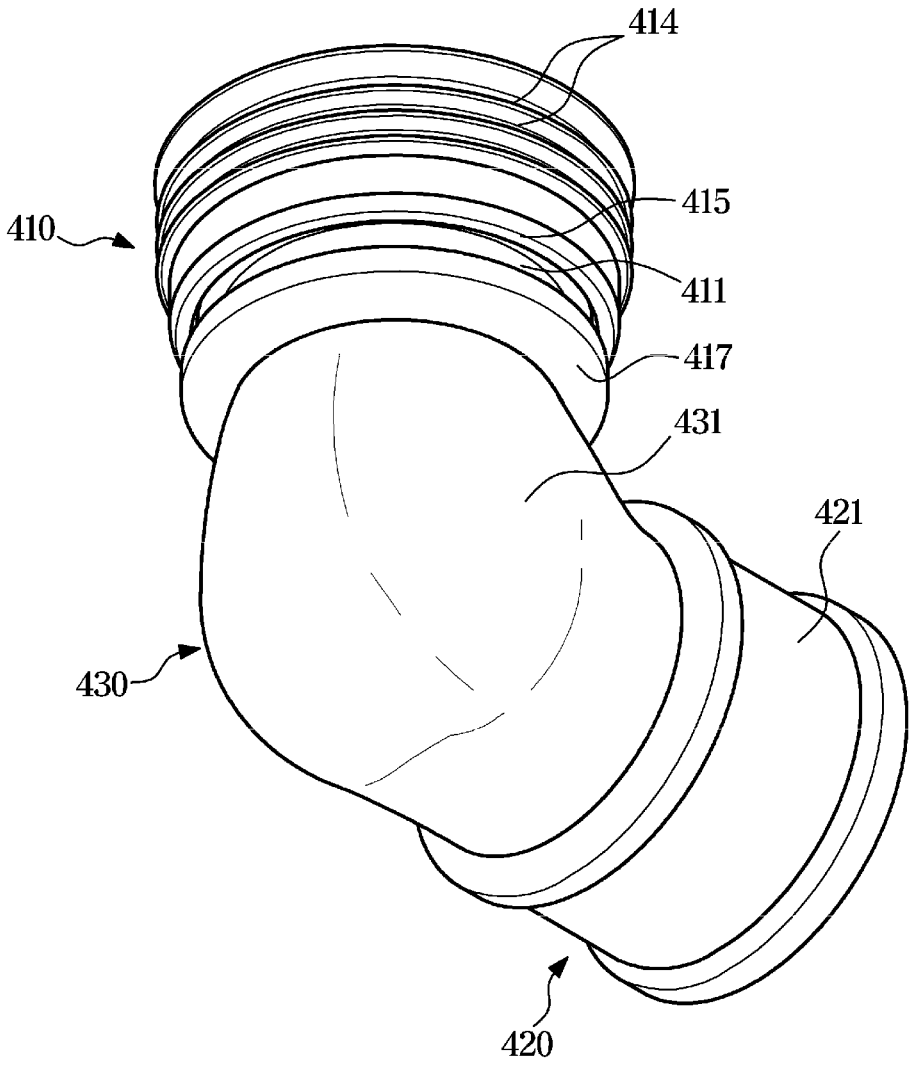
FIG. 10 is a perspective view of the connector of the dishwasher according to an embodiment of the disclosure.

FIG. 4 is a cross-sectional view of a lower portion of the dishwasher according to an embodiment of the disclosure, FIG. 5 is cross-sectional view of some components of the dishwasher according to an embodiment of the disclosure, FIG. 6 is an enlarged cross-sectional view of a portion of FIG. 5, and FIG. 7 is an enlarged view of a portion of a sump of the dishwasher according to an embodiment of the disclosure.

As illustrated in FIG. 4, below the tub 12 in the downward direction, the machine room L, in which components such as the circulation pump 30 connected to the sump 300 (refer to FIG. 1), the alternating device 200 connected to the circulation pump 30, the flow path, and the connector 400, are installed, may be arranged.

With respect to the tub 12 and the sump 300, the upper side of the lower surface 12*b* and the inner portion 310*a* of the sump 300 may be partitioned into the washing chamber C, and the lower side of the bottom surface 12*c* and the outer portion 310*b* of the sump 300 may be partitioned into the machine room L.

The machine room L is where the configuration for circulating the wash water is arranged, and the capacity of the washing chamber C may be increased or decreased according to the height of the machine room L.

That is, as a minimum installation height for installing components is less in the machine room L, an overall height of the machine room L may be reduced and thus a height of the washing chamber C may be increased as much as the reduction of the height of the machine room L.

In the conventional dishwasher, the lower injection unit and the connector are coupled to each other in the inside of the machine room L. This is because it is effective that a part of the lower injection unit extends to the inside of the machine room L and then directly coupled to the connector in the inside of the machine room L or the connector is coupled to the sump or the bottom surface of the tub.

The conventional dishwasher may further include a component for sealing, such as a clamp, to prevent leakage that may occur when the connector is coupled to the injection unit, the sump or the bottom surface of the tub.

The clamp may constrain one end of the connector, which is connected to a portion of the lower injection unit, the sump or the tub, so as to prevent the wash water from leaking at one end of the connector.

At this time, because in the machine room L, a minimum installation height is increased as much as a height of the clamp coupled to the one end of the connector, the height of the machine room L may be increased.

In addition, because the clamp constrains a part of the connector while being coupled to one end of the connector, the shape of the connector may be partially deformed and thus the flow of the wash water flowing in the inside of the connector may be inhibited.

The connector includes a curved surface to facilitate the flow of the wash water. This is to prevent the water pressure from being lowered due to a collision in the connector during the wash water is moved from the pump or the alternating device to the injection unit.

However, at least a part of the curved surface of the connector is deformed by the clamp or the curvature of the curved surface is increased by the height at which the connector and the clamp are coupled and thus it is difficult to form a smooth curved surface in the inside of the connector. Therefore, it is possible to inhibit the flow of the wash water.

In order to ease such a difficulty, as for the connector 400 according to an embodiment of the disclosure, at least a part of the connector 400 may be coupled to the first injection unit 41 in the washing chamber C.

Accordingly, as illustrated in FIG. 5, the height of the machine room L may be reduced as much as a minimum height H, which is needed for coupling the connector 400 to the first injection unit 41, and thus the height of the washing chamber C may be increased as much as the height H for coupling the connector 400 to the first injection unit 41. Therefore, the capacity of the washing chamber C may be increased.

In addition, because the sealing of the connector 400 and the first injection unit 41 is implemented by the coupling portion 320 formed in the upper side of the sump 300, an additional component such as a clamp for sealing the connector 400 is not required.

Therefore, because the shape of the connector 400 is not deformed by the external configuration, the flow of the wash water moving in the inside of the connector 400 may be maintained without interruptions.

In addition, as mentioned above, because a portion where the connector 400 is coupled to the first injection unit 41 is formed in the washing chamber C, a height E, in which the connector 400 is to be installed, in the machine room L may be relatively greater than the conventional dishwasher.

Accordingly, it is possible to form a curved surface G of the connector 400 having a radius of curvature the same as the installable height E of the connector 400, and thus it is possible to design the curved surface G of the connector 400 having an optimal curvature for guiding the wash water.

Particularly, as illustrated in FIG. 6, at least a part of the connector 400 and the first injection unit 41 may be coupled to each other in the inside of the washing chamber C.

Figure 13:
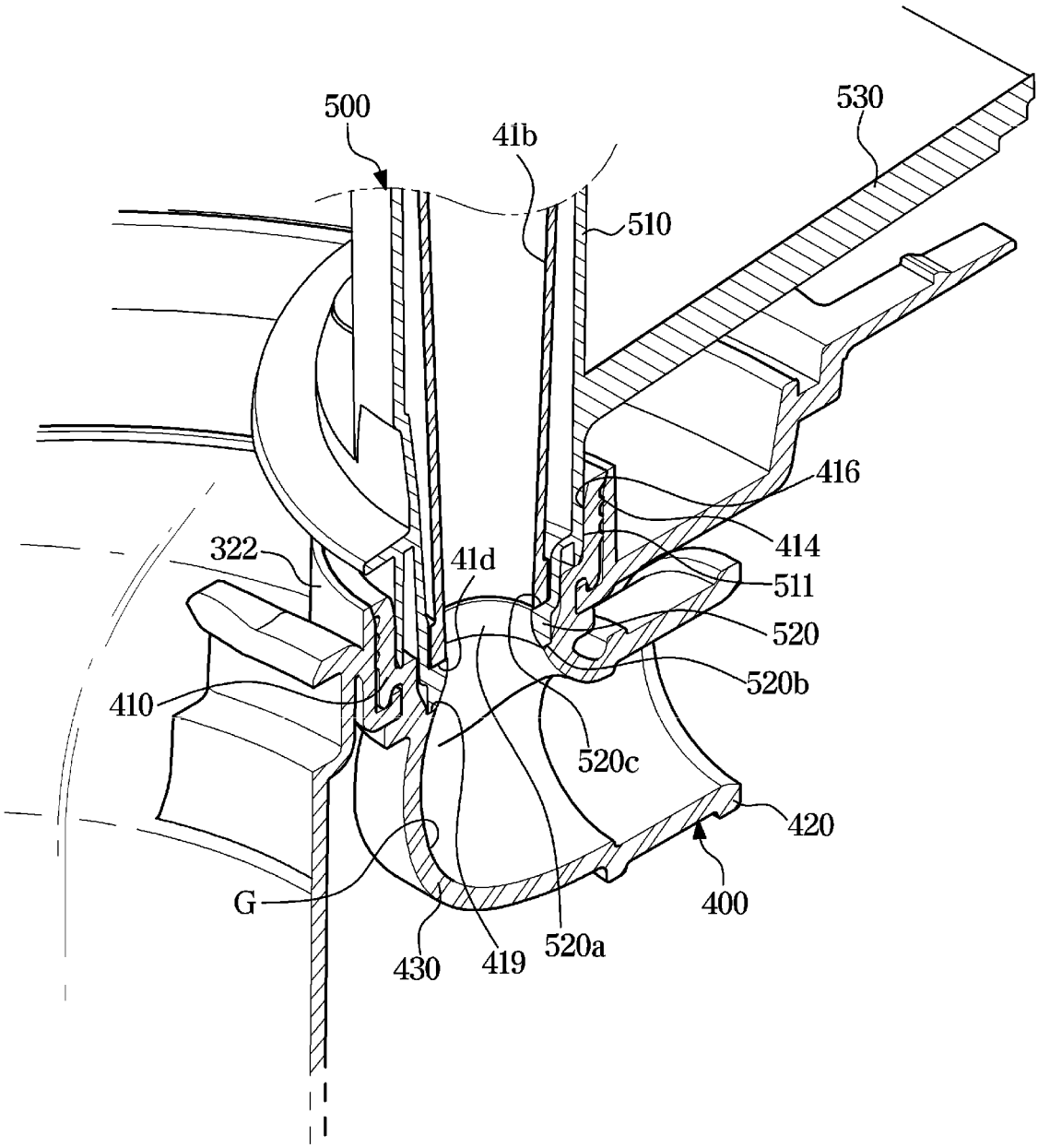
FIG. 13 is a cross-sectional perspective view of the sump, the connector, the intermediate member, and an inlet of the dishwasher according to an embodiment of the disclosure.

The first injection unit 41 may include the inlet 41*b* arranged in the lower side of the rotating shaft 41*a* and provided to allow the wash water to flow into the first injection unit 41 (refer to FIG. 13).

The inlet 41*b* may be provided in a tubular shape, and the wash water introduced into the inlet 41*b* may be supplied to the first injection unit 41 through the inside of the rotating shaft 41*a*.

The connector 400 may be provided in a bent tubular shape configured to supply wash water, which is pumped by the circulation pump 30, to the inlet 41*b*.

On the sump extension 315, the connector 400 and the inlet 41*b* may be coupled to each other in the vertical direction.

The sump 300 may include the coupling portion 320 arranged on the sump extension 315. The inlet 41*b* may be coupled from the upper side to the lower side of the coupling portion 320, and the connector 400 may be coupled from the lower side to the upper side.

The connector 400 may include a tubular first body portion 411 extending in the first direction D1 facing upward in the height direction. When a portion of the connector 400 coupled to the coupling portion 320 in the upper side of the sump first surface 315*a* of the coupling portion 320 is defined as a first region 410 of the connector 400, the first body portion 411 may be arranged in the first region 410.

The connector 400 may include a tubular second body portion 421 extending in a second direction D2 perpendicular to the first direction D1. When a portion of the connector 400 in which the wash water supplied from the circulation pump 30 is supplied through the alternating device 200 is defined as a second region 420, the second body portion 421 may be arranged in the second region 420.

The connector 400 may include a bent tubular third body portion 431 forming at least a portion of the curved surface G formed from the first direction D1 toward the second direction D2. When a portion of the connector 400 arranged between the first region 410 and the second region 420 is defined as a third region 430, the third body portion 431 may be arranged in the third region 430.

The first region 410, the second region 420, and the third region 430 as illustrated in FIG. 6 are merely an example of a divided region of the connector 400, and thus it is not required to have the same shape as illustrated in FIG. 6.

However, with respect to the connector 400 according to an embodiment of the disclosure, a region extending toward the first direction D1 and positioned in the upper side of a line A1 may be defined as the first region 410, a region extending toward the second direction D2 and positioned in the right side of a line A2 may be defined as the second region 420, and a region connecting the first region 410 to the second region 420 and positioned between the line A1 and the line A2 may be defined as the third region 430.

Approximately from an upper end of the connector 400 to a contact portion 417 described later may be defined as the first region 410, and from the other end of the connector 400 to a portion, to which the alternating device 200 is inserted, may be defined as the second region 420.

As mentioned above, the coupling portion 320 may be coupled to the inlet 41*b* of the connector 400 in the vertical direction with respect to the sump first surface 315*a*.

As illustrated in FIGS. 7 to 10, the coupling portion 320 may include a coupling tube 322 provided with a hollow 321 formed on the sump first surface 315*a* and provided to extend from the sump first surface 315*a* to the upper side.

The first region 410 may be fitted into the inside of the coupling tube 322 through the hollow 321 of the coupling tube 322. The connector 400 may be formed of a poly material such as rubber, and thus its shape may be easily changed.

A diameter d1 of the hollow 321 formed in the coupling tube 322 may be less than an outermost diameter d3 of the first region 410 coupled to the coupling portion 320. Accordingly, in order that the connector 400 passes through the hollow 321 to be coupled to the inside of the coupling tube 322, the shape of the connector 400 may be temporarily changed to penetrate the hollow 321, thereby being fitted to the inside of the coupling tube 322.

A first sealing portion 414 may be arranged in the first region 410 so that when the first region 410 is fitted to the coupling tube 322, the first sealing portion may be in contact with an inner circumferential surface 322*a* of the coupling tube 322 to seal the connector 400 and the coupling portion 320.

The first sealing portion 414 may be provided in a shape extending from the first body portion 411 radially outward of the first body portion 411. A diameter of the first body portion 411 may be less than a diameter of the first sealing portion 414.

The first sealing portion 414 may also extend to the upper side of the first body portion 411. Accordingly, an upper end of the first sealing portion 414 formed by the first sealing portion 414 may form an upper end of the connector 400.

The intermediate member 500 and the inlet 41*b* of the first injection unit 41 may be inserted through an opening formed at the upper end of the first sealing portion 414.

The coupling portion 320 may include an annular flange 323 extending from the inner circumferential surface 322*a* of the coupling tube 322 to the center of the coupling tube 322 and provided with an annular insertion groove 325 provided to be concave downward.

The flange 323 may extend to the center of the coupling tube 322 from the lower end of the inner circumferential surface 322*a* of the coupling tube 322.

The hollow 321 may be formed along an inner circumferential end of the flange 323.

The flange 323 may include an annular extension protrusion 324 extending upward from the inner circumferential end of the flange 323. The insertion groove 325 may be formed between the annular extension protrusion 324 and the inner circumferential surface 322*a* of the coupling tube 322.

An insertion portion 415 may be provided in the first region 410, and thus when the connector 400 and the coupling portion 320 are coupled to each other, the insertion portion 415 may be inserted into the insertion groove 325 from the upper side to the lower side.

The insertion portion 415 may extend downward from the lower end of the first sealing portion 414.

As the insertion portion 415 is inserted into the insertion groove 325 and the first sealing portion 414 is sealed to the inner circumferential surface 322*a* of the coupling tube 322, the connector 400 and the coupling portion 320 may be closely coupled to each other.

The diameter d1 of the hollow 321 (or the diameter of the inner circumferential end of the flange 323) may be less than a diameter d2 of the inner circumferential surface 322*a* of the coupling tube 322 or a diameter d3 of the outermost circumferential surface of the first region 411 (or the diameter of the insertion portion 415).

Therefore, even when the connector 400 is pulled downward by the external force, the connector 400 may be supported by the coupling portion 320 because the diameter d1 of the hollow 321 is less than the diameter d3 of the outermost circumferential surface of the first region 411. Accordingly, the connector 400 may maintain the coupling with the coupling portion 320 without being moved downward even when the tension is applied. in the downward direction.

Particularly, because the first region 410 is supported by the flange 323 in the vertical direction, it is possible to prevent the connector 400 from being separated from the coupling portion 320.

The contact portion 417 may be arranged in the first region 410 and thus when the connector 400 is coupled to the coupling portion 320, the contact portion 417 may be in contact with the lower side of the flange 323.

By being in contact with the lower side of the flange 323, the contact portion 417 may further prevent the separation of the first region 410.

Particularly, when the connector 400 is pulled upward by the external force generated from the upper side, the contact portion 417 may be supported against the lower side of the flange 323 so as to prevent the connector 400 from being separated from the coupling portion 320.

As mentioned above, the dishwasher 1 may include the intermediate member 500 arranged between the first injection unit 41 and the coupling tube 322 to guide coupling between the first injection unit 41 and the coupling portion 320.

Figure 11:
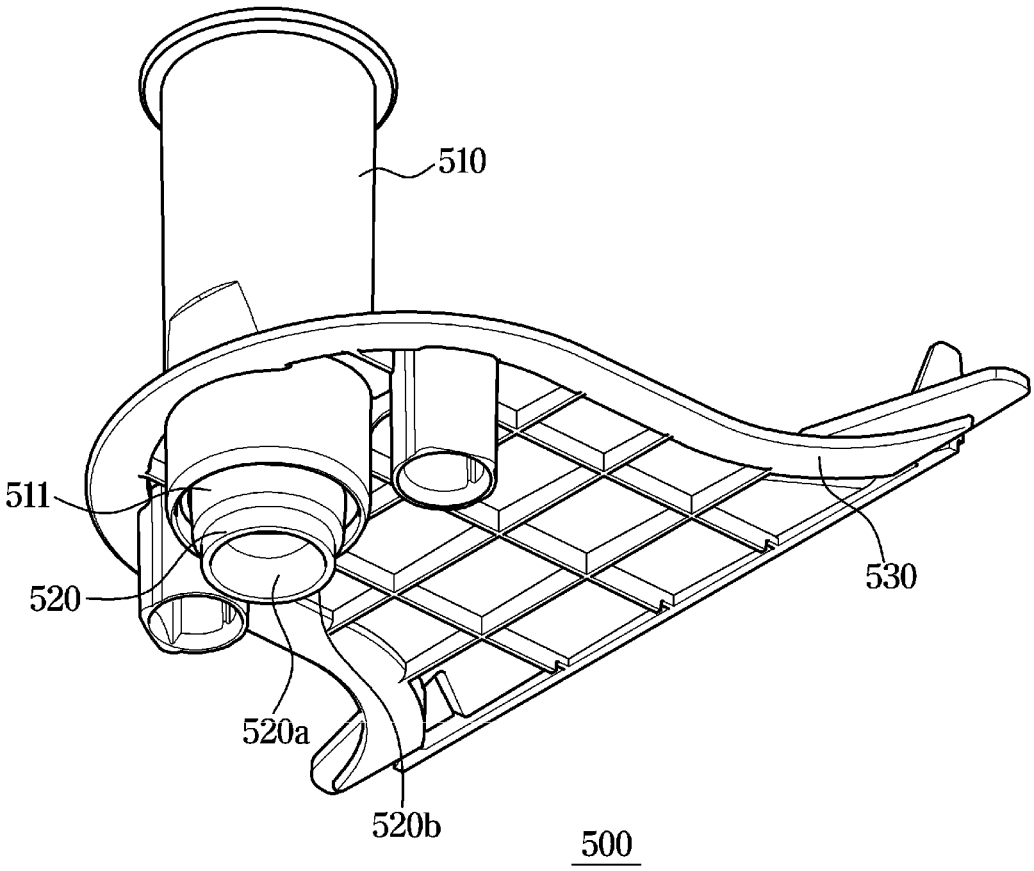
FIG. 11 is a bottom perspective view of an intermediate member of the dishwasher according to an embodiment of the disclosure.
Figure 12:
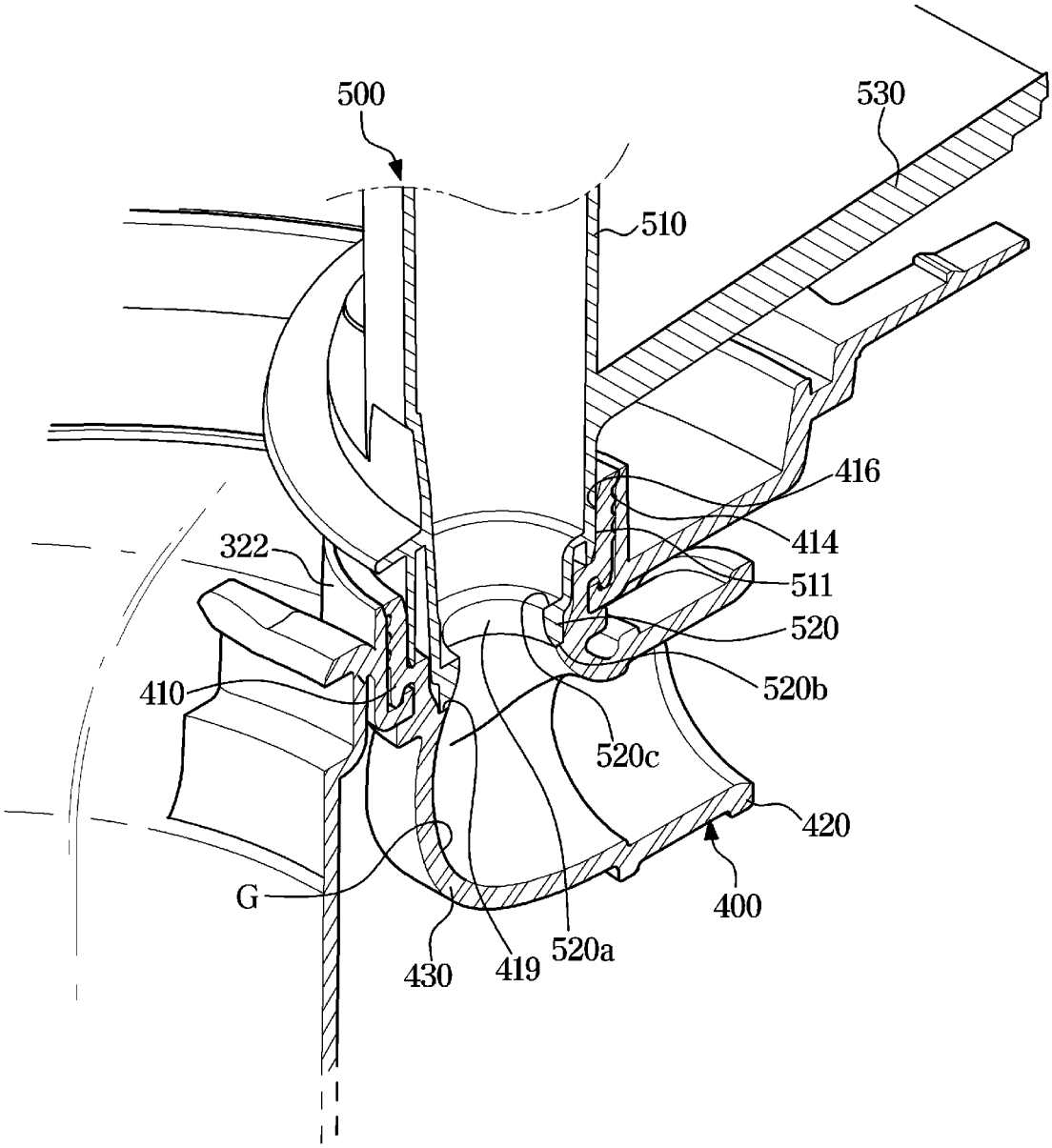
FIG. 12 is a cross-sectional perspective view of the sump, the connector and the intermediate member of the dishwasher according to an embodiment of the disclosure.

As illustrated in FIGS. 11 to 13, the intermediate member 500 may include an intermediate portion 510 inserted into the connector 400 and arranged between the connector 400 and the first injection unit 41 and the filter support 530 configured to support the filter body 331 as mentioned above.

The intermediate portion 510 forms a main body of the intermediate member 500 and provided in a tubular shape. At least a portion of the intermediate portion 510 may be provided to be inserted into the coupling tube 332 and the connector 400.

The filter support 530 may be provided to extend outward from an outer circumferential surface of the intermediate portion 510.

A second sealing portion 416 arranged opposite to the first sealing portion 414 and configured to seal the intermediate portion 510 may be arranged in the first region 410.

The intermediate portion 510 may include a third sealing portion 511 in contact with the second sealing portion 416. The third sealing portion 511 may be arranged on an outer circumferential surface of a portion of the intermediate portion 510 that is inserted into the connector 400.

The outer circumferential surface side of the first region 410 may be sealed with the coupling tube 322 by the first sealing portion 414, and the inner circumferential surface side of the first region 410 may be sealed with the intermediate member 500 by the second sealing portion 416.

The outer and inner circumferential surface sides of the first region 410 are all sealed and thus the connector 400 may be double-sealed by the coupling portion 320 and the coupling member 500.

The inlet 41*b* of the first injection unit 41 may be inserted into the intermediate portion 510. The intermediate portion 510 and the inlet 41*b* may be fitted to the coupling tube 322.

The coupling tube 322, the intermediate portion 510, and the inlet 41*b* may be sequentially arranged from the outside of the coupling tube 322 with respect to the center of the coupling tube 322.

By fitting the intermediate portion 510 to the inlet 41*b*, the intermediate portion 510 and the inlet 41*b* may press each other in the coupling tube 322, thereby increasing coupling force in the inside of the coupling tube 322.

The intermediate member 500 may include a guide 520 arranged at a lower end of the intermediate portion 510 so as to guide the wash water moving in the connector 400 to the inlet 41*b*.

The guide 520 may extend from a lower end of the intermediate portion 510 and be provided in a tubular shape. A lower end 520*b* of the guide 520 may form the lower end of the intermediate member 500. An upper end 520*c* of the guide 520 may be provided in an annular shape protruding toward the center from the inner circumferential surface of the intermediate portion 510.

The lower end 520*b* of the guide 520 may be arranged in contact with an upper end 419, which will be described later, in which the curved surface G ends, in the first body portion 411.

The upper end 520*c* of the guide 520 may be in contact with a lower end 41*d* of the inlet 41*b*. That is, the lower end 520*b* of the guide 520 may communicate with an opening formed as the upper end portion of the curved surface G in the first body portion 411. The opening formed by the lower end 520*b* of the guide 520 may correspond to an opening formed by the upper end 419 of the curved surface G in the first body portion 411.

In addition, the upper end 520*c* of the guide 520 may be provided to communicate with the lower end 41*d* of the inlet 41*b*. The opening formed by the upper end 520*c* of the guide 520 may correspond to an opening formed by the lower end 41*d* of the inlet 41*b*.

The opening formed by the upper end 520*c* of the guide 520 may be smaller than the opening formed by the lower end 520*b*. Accordingly, the inner circumferential surface 520*a* of the guide 520 may be formed such that a cross section in the inside of the guide 520 becomes narrower as it goes to the upper side from the lower side.

After the wash water flows into the connector 400, the wash water may flow into the inlet 41*b* through the upper end 419 and the guide portion 520 of the curved surface G in the inside of the first body portion 411, and then flow to the first injection unit 41.

The inner circumferential surface 520*a* of the guide 520 may be formed to have a curved surface connected to the inner curved surface G of the connector 400, which will be described later. By the curved surface G connected from the inside of the connector 400 and by the curved surface of the inner circumferential surface 520*a* of the guide 520, the wash water may be moved to the first injection unit 41 without loss of water pressure.

The curved surface G may be formed by an inner circumferential surface 431*a* of the third body portion 431 and an inner circumferential surface 411*a* of the first body portion 411 (refer to FIG. 6).

The curved surface G refers to a curved surface G arranged in a direction to which the wash water, which flows through the second body portion 421 in the connector 400, is directed. However, the disclosure is not limited thereto, and thus the curved surface G may include a curved surface formed on an inner circumferential surface opposite to the curved surface G illustrated in FIG. 6 on the inner circumferential surface of the connector 400.

The curved surface G illustrated in FIG. 6 may cause a decrease in the efficiency of the dishwasher 1 because the water pressure of the wash water is lowered or the flow rate is lowered due to a collision when the wash water flows into the connector 400. Therefore, hereinafter only the curved surface G arranged on one side of the connector 400 will be described.

However, although not described below, the disclosure will be equally applied to a curved surface arranged on the other side of the connector 400.

As mentioned above, as for the connector 400, the first region 410 is arranged in the washing chamber C and then coupled to the coupling portion 320 formed in the washing chamber C. That is, a minimum height H of the connector 400 for coupling is not included in the installable height E of the connector 400 in the machine room L (refer to FIG. 5).

Accordingly, in the installable height E of the connector 400, a length in which the inner curved surface G is formed in the height direction may be increased.

Therefore, the inner curved surface G may guide the wash water while maintaining a small change in curvature, and thus the inner curved surface G may move the wash water to the first injection unit 41 while minimizing a decrease in the water pressure of the wash water.

When the coupling minimum height H of the connector 400 is included in the installable height E of the connector 400 as in the conventional manner, the inner curved surface G of the connector 400 may have a relatively large curvature because a range extendable in the height direction is reduced.

At this time, the wash water flowing along the inner curved surface G of the connector 400 may be reduced in water pressure or flow rate due to the large curvature of the curved surface G.

However, because the curved surface G of the connector 400 according an embodiment of the disclosure may sufficiently extend in the height direction, the curved surface G may easily guide the wash water.

In addition, the inner circumferential surface 520*a* of the guide 520 may extend from the lower end 520*b* of the guide 520, which faces the upper end 419 of the curved surface G, to the upper end 520*c*.

The inner circumferential surface 520*a* of the guide 520 may be provided to be connected to the curved surface G. That is, the lower end of the inner circumferential surface 520*a* of the guide 520 may be formed to extend from the upper end 419 of the curved surface G.

The inner circumferential surface 520*a* of the guide 520 may include a curved surface extending from the lower end 520*b* of the guide 520 to the upper end 520*c*.

The curved surface of the inner circumferential surface 520*a* of the guide 520 and the curved surface G of the connector 400 may be connected to each other without a step and thus the wash water may be easily guided to the inlet 41*b*.

Further, the upper end 520*c* of the guide 520 and the lower end 41*d* of the inlet 41*b* may be arranged to be in contact with each other. The inner circumferential surface 520*a* at the upper end 520*c* side of the guide 520 and the inner circumferential surface at the lower end 41*d* side of the inlet 41*b* may be in connect with each other.

Therefore, even when the wash water is moved from the guide 520 to the inlet 41*b*, it is possible to minimize the loss of water pressure caused by a collision.

From the inside of the second body portion 421 into which the wash water flows, to the inside of the connector 400, the inside of the intermediate member 500 connected to the connector 400, and the inside of the intermediate member 500 connected to the inlet 41*b* may be formed with a curved surface. Therefore, the connector 400 may effectively move the wash water to the inlet 41*b*.

Therefore, while the wash water is moved from the alternating device 200 to the first injection unit 41, the wash water may be guided to the curved surface formed in the inside of the connector 400 and the intermediate member 500, thereby minimizing the loss of flow rate due to a collision.

Hereinafter a connector 400' and a coupling member 500' of a dishwasher 1 according to an embodiment of the disclosure will be described. The configuration other than the connector 400' and the coupling member 500' described below is the same as the configuration of the dishwasher 1 according to the above-described embodiment, and the same description thereof will be omitted.

Figure 14:
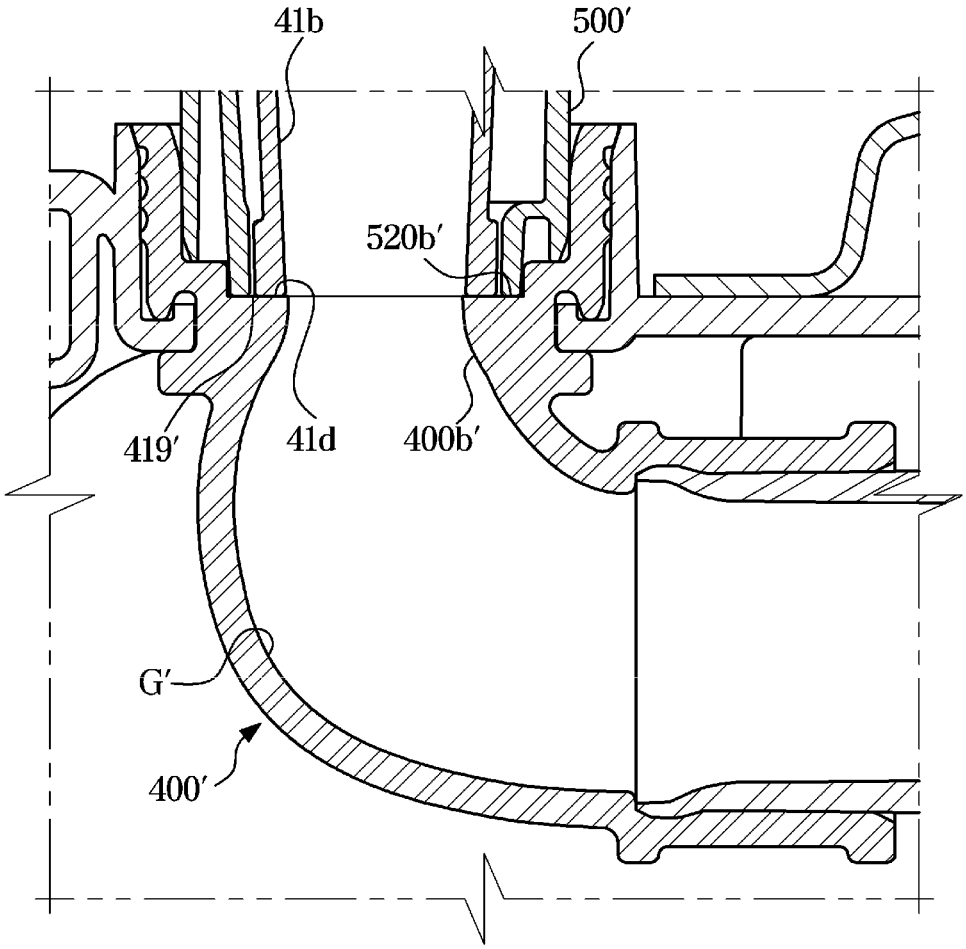
FIG. 14 is a cross-sectional view of some components of a dishwasher according to an embodiment of the disclosure.

FIG. 14 is a cross-sectional view of some components of a dishwasher according to an embodiment of the disclosure.

As illustrated in FIG. 14, an upper end 419' of a curved surface G' of a connector 400' may be directly in contact with an inlet 41*b*. At this time, a guide 520 of an intermediate member 500' is not arranged between the inlet 41*b* and the upper end 419' of the curved surface G' in the vertical direction, and the intermediate member 500' includes a lower end 520*b'*.

An opening formed in the upper end 419' of the curved surface G' may be formed to correspond to an opening formed in a lower end 41*d* of the inlet 41*b*. In addition, an inner circumferential surface 400*b'* at the upper end 419' of the curved surface G' and an inner circumferential surface at the lower side of the inlet 41*b* may be connected to each other.

The curved surface G' formed in the inside of the connector 400' may be connected to the inner circumferential surface at the lower end side of the inlet 41*b*.

Accordingly, it is possible to minimize a decrease in the flow rate while the wash water flowing through the connector 400' is discharged from the upper end 419' of the curved surface G' and moved to the inlet 41*b*.

As is apparent from the above description, as for the connector connecting the circulation pump or the alternating device to the lower injection unit, a region, in which the connector is coupled to the lower injection unit, is provided in the inside of the tub and thus it is possible to efficiently utilize the space under the tub. Accordingly, it is possible to effectively form the shape of the wash water flow path of the connector. Further, because the connector and the lower injection unit are coupled to each other in the inside of the tub, it is possible to simplify the coupling between the connector and the lower injection unit in the inside of the tub without an additional coupling component such as a clamp.

Although a few embodiments of the disclosure have been shown and described, it would be appreciated by those skilled in the art that changes may be made in these embodiments without departing from the principles and spirit of the disclosure, the scope of which is defined in the claims and their equivalents.

Description of symbols

| | |
|---|---|
| 1: dishwasher | 10: main body |
| 11: door | 12: tub |
| 20: sump | 30: circulation pump |
| 41: first injection unit | 42: second injection unit |
| 43: third injection unit | 51: lower basket |
| 52: intermediate basket | 53: upper basket |
| 100: duct | 200: alternating device |
| 300: sump | 310: sump housing |
| 311: reservoir | 315: sump extension |
| 320: coupling portion | 321: hollow |
| 322: coupling tube | 323: extension |
| 324: extension protrusion | 325: insertion groove |
| 330: filter unit | 400: connector |
| 410: first region | 411: first body portion |
| 414: first sealing portion | 415: insertion portion |
| 416: second sealing portion | 417: contact portion |
| 420: second region | 421: second body portion |
| 430: third region | 431: third body portion |

What is claimed is:

1. A dishwasher comprising:

a main body;

a tub provided in the main body;

a basket configured to be placed in the tub to accommodate dishes;

an injector provided in the tub and configured to spray water to wash dishes accommodated in the basket;

a sump configured to receive the water sprayed to wash the dishes accommodated in the basket, provided at a lower surface of the tub, the sump including:

a coupling tube formed to extend into the tub, a portion of the injector being provided in an inner circumferential space of the coupling tube;

a reservoir provided to store water, and a sump housing provided to form the reservoir, the sump housing comprising a sump extension provided to extend outward from an upper portion of the reservoir, where the coupling tube is provided to extend upward from the sump extension, a circulation pump configured to circulate the water from the sump; and a connector provided to connect the circulation pump to the injector to transfer the water from the circulation pump to the injector, and including:

a first end connected to the circulation pump, a second end formed to extend into the tub and be fitted inside a part of the coupling tube provided in the tub, and connected to the portion of the injector provided in the inner circumferential space of the coupling tube, and a tubular shaped portion formed to extend between the first end and the second end, wherein the connector comprises:

a first region coupled to the coupling tube at an upper side of the lower surface of the tub, a second region connected to the circulation pump, a third region arranged between the first region and the second region, a first body portion arranged in the first region and provided to extend in a first direction, a second body portion arranged in the second region and provided to extend in a second direction perpendicular to the first direction, and a third body portion arranged in the third region and provided to be bent from the second direction to the first direction, wherein the connector comprises an inner curved surface formed inside the first body portion and the third body portion, and provided to be bent from the second direction to the first direction.

2. The dishwasher of claim 1, wherein the coupling tube comprises a hollow formed in the sump extension, the coupling tube is provided to extend upward from the sump extension, and the first region is fitted into the coupling tube through the hollow of the coupling tube.

3. The dishwasher of claim 2, wherein the connector comprises a first sealing portion in contact with an inner circumferential surface of the coupling tube to seal the connector and the coupling tube, wherein the first sealing portion is provided to extend radially outward from the first body portion.

4. The dishwasher of claim 2, wherein the coupling tube comprises an annular flange extending from an inner circumferential surface of the coupling tube to a center of the coupling tube and comprising an annular insertion groove provided to be concave downward, wherein the first region further comprises an insertion portion inserted into the annular insertion groove in a vertical direction.

5. The dishwasher of claim 4, wherein the annular flange extends from a lower end of the inner circumferential surface of the coupling tube toward the center of the coupling tube, and a diameter of the inner circumferential surface of the coupling tube is greater than a diameter of an inner circumferential end of the annular flange.

6. The dishwasher of claim 2, further comprising:

an intermediate member arranged between the injector and the coupling tube to guide coupling between the injector and the coupling tube, wherein the injector comprises an inlet provided to be inserted into the connector and configured to transfer water to the injector, and the intermediate member is arranged between the first region and the inlet in a radial direction of the coupling tube.

7. The dishwasher of claim 6, wherein the connector further comprises a first sealing portion in contact with an inner circumferential surface of the coupling tube and a second sealing portion arranged opposite to the first sealing portion and sealed with the intermediate member, and the intermediate member comprises a third sealing portion in contact with the second sealing portion.

8. The dishwasher of claim 6, wherein the intermediate member further comprises a guide comprising a first end communicating with an upper end of the inner curved surface and a second end communicating with a lower end of the inlet to guide water to the inlet, wherein an opening at an upper end of the guide corresponds to an opening at a lower end of the inlet, and an opening at a lower end of the guide corresponds to an opening at an upper end of the inner curved surface.

9. The dishwasher of claim 8, wherein a diameter of the opening at the upper end of the guide is less than a diameter of the opening at the lower end of the guide.

10. The dishwasher of claim 8, wherein an inner circumferential surface of the guide comprises a curved surface of the guide connected to the inner curved surface.

11. The dishwasher of claim 6, wherein the sump further comprises a filter arranged above the sump housing and configured to prevent foreign substances from entering the sump housing, and the coupling tube is arranged between the filter and the lower surface of the tub.

12. The dishwasher of claim 11, wherein the intermediate member comprises a filter support provided to extend radially outward of the intermediate member and configured to support the filter.

13. The dishwasher of claim 1, further comprising an alternating device through which water pumped by the circulation pump is distributed, wherein the second region is directly coupled to the alternating device.

14. A dishwasher comprising:

a main body;

a tub provided in the main body and including a washing chamber;

a basket configured to be placed inside the washing chamber to accommodate dishes;

an injector provided in the tub and configured to spray water to wash the dishes accommodated in the basket;

a sump configured to receive the water sprayed to wash the dishes accommodated in the basket, and provided at a lower surface of the tub, the sump including:

a reservoir provided to store water, a sump housing provided to form the reservoir, the sump housing comprising a sump extension provided to extend outward from an upper portion of the reservoir, and a coupling tube provided to extend upward from the sump housing;

a circulation pump configured to circulate the water from the sump;

a connector provided to connect the circulation pump to the injector to transfer the water from the circulation pump to the injector and the injector and the connector being coupled in the coupling tube, and including:

a first end connected to the circulation pump, a second end which protrudes upward through the sump and into the tub to be connected to the injector above the lower surface of the tub, the second end being fitted inside the coupling tube of the sump, and a tubular shaped portion formed to extend between the first end and the second end; and a filter arranged above the sump to prevent foreign substances from entering the sump, the coupling tube being provided between the filter and the lower surface of the tub, wherein an outer circumferential surface of the connector is sealed with an inner circumferential surface of the coupling tube, wherein the connector comprises:

a first region coupled to the coupling tube at an upper side of the lower surface of the tub, a second region connected to the circulation pump, a third region arranged between the first region and the second region, a first body portion arranged in the first region and provided to extend in a first direction, a second body portion arranged in the second region and provided to extend in a second direction perpendicular to the first direction, and a third body portion arranged in the third region and provided to be bent from the second direction to the first direction, and wherein the connector comprises an inner curved surface formed inside the first body portion and the third body portion, and provided to be bent from the second direction to the first direction.

* * * * *